US006193106B1

(12) United States Patent
Ho et al.

(10) Patent No.: US 6,193,106 B1
(45) **Date of Patent: *Feb. 27, 2001**

(54) DISPENSER

(75) Inventors: Stanley Ho, Warren, NJ (US); Mark Ho, Taipei (TW)

(73) Assignee: Allure Home Creation Co., Inc., Boonton, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/406,970

(22) Filed: Sep. 28, 1999

Related U.S. Application Data

(62) Division of application No. 08/844,225, filed on Apr. 18, 1997.

(51) Int. Cl.[7] ..... B67D 5/60

(52) U.S. Cl. ..... 222/78; 222/131; 222/321.7; 428/13; 40/406; 40/410; 446/267

(58) Field of Search ..... 222/78, 130, 131, 222/321.7, 382, 383.1, 402.1, 562; 40/406, 410; 428/13; 446/267

(56) References Cited

U.S. PATENT DOCUMENTS 2,991,574 * 7/1961 Trame ..... 40/406
4,475,274 * 10/1984 Beckstrom et al. ..... 222/562
4,928,412 * 5/1990 Nishiyama ..... 40/406
5,224,631 * 7/1993 Wells et al. ..... 222/402.1
5,286,535 * 2/1994 Hou ..... 428/13
5,291,674 * 3/1994 Torrence ..... 40/110
5,526,960 * 6/1996 Breidenbcah et al. ..... 222/321.7
6,065,640 * 5/2000 Ho et al. ..... 222/321.7

* cited by examiner

*Primary Examiner*—Philippe Derakshani
(74) *Attorney, Agent, or Firm*—Frommer Lawrence & Haug

(57) ABSTRACT

Disclosed and claimed is a dispenser, such as a pump, pour or aerosol dispenser, for dispensing a liquid from a reservoir, and methods for making and using the dispenser. The dispenser includes a hollow decorative vessel having a decorative element. The decorative vessel is capable of containing a first liquid. The reservoir is connected to the hollow decorative vessel. The reservoir is capable of containing a second liquid and having an interior therefor. And, the dispenser includes apparatus for dispensing the second liquid from the interior of the reservoir. The dispenser can include the first liquid and particles in suspension for a period of time when the liquid is shaken, such that the hollow decorative vessel can be a "snow globe". The hollow decorative vessel can be positioned atop the reservoir or, below the reservoir. Alternatively, the hollow decorative vessel can be surrounded by the reservoir. And as another alternative, the hollow decorative vessel can contain the reservoir.

24 Claims, 19 Drawing Sheets

DISPENSER

This application is a division of Ser. No. 08/844,225 filed Apr. 18, 1997.

RELATED APPLICATIONS

Reference is made to Taiwanese patent application No. 86200066, filed Jan. 15, 1997, and Chinese patent application No.97204313.X, filed on Feb. 3, 1997, both of which are incorporated herein by reference.

FIELD OF THE INVENTION

The present invention relates to a dispenser for a fluid. The dispenser is preferably for a liquid, and is a pump-type dispenser, such as a dispenser for soap, shampoo, shower gel or the like. The dispenser can be sized as desired. For example, the dispenser may be sized so it is suitable for display on a shelf or a sink (e.g., a bathroom sink), or for use in the home. For instance, it can have a diameter of about four inches and a height of about seven inches. The dispenser includes a decorative vessel and a reservoir to contain liquid to be dispensed. The decorative vessel can be hollowed and positioned above the reservoir. The reservoir can be refillable. The hollow decorative vessel can also contain a three-dimensional decorative structure or sculpture and a fluid and insoluble material capable of being in suspension for a period of time when the dispenser is shaken, such that the hollow decorative vessel can have a "snow globe" appearance. Documents cited in the following text are incorporated herein by reference.

BACKGROUND OF THE INVENTION

Dispensers for liquids are varied. A cleansing solution such as shampoo may be dispensed from an open-mouthed bottle. But, open-mouth bottles are not aesthetically pleasing, and do not allow the user to dispense only a particular amount of the cleansing solution at each use.

There are also pump-type dispensers. Conventional pump-type dispensers include a pumping means having a dispensing tube and an actuator. A user depresses the actuator which forces gas into the dispensing tube and into a stationary bottle (with respect to the actuator or pump nozzle). This creates a vacuum that forces the liquid in the bottle to rise within a tube and exit from the actuator. The actuator of a pump-type dispenser is typically positioned at the top of the bottle. Pump-type dispensers are also used to dispense liquids such as cleansing solutions (e.g., shower gel, shampoo) or lotions or hair conditioner.

There are also aerosol type dispensers which dispense a fluid under pressure from a canister or other suitable vessel.

The invention relates to a different and novel dispenser for liquids. While the dispenser of the present invention can be used to dispense any fluid or liquid or even solids in forms such as pastes, powders or creams, the inventive dispenser is used preferably for cleansing solutions such as shower gel, shampoo, lotions, conditioners, or the like. The appearance or design of a dispenser is desirably aesthetically pleasing and can be reusable.

Meeting these desires has been hampered by the functional limitation of the pump spray dispenser, namely, that the actuator must be depressed to deliver the liquid.

Presently available dispensers for shower gel or for shampoo are predominantly made from blow-molding a disposable container, with an actuator mechanism atop the container. The dispensers can have a design printed on the outer surface of the container, or animals or cartoon characters on top of the actuator, to make the dispenser attractive. There are also available clear disposable dispensers for soap that contain a polymer sheet that is within the dispenser and contains a picture imprinted on the polymer sheet.

A "snow globe" is a decorative device. A typical snow globe has a hollow, clear vessel, usually spherical or globe-shaped atop a base. The hollow, clear sphere or globe contains a fluid and insoluble material capable of being in suspension for a period of time when the snow globe is shaken. Usually, there is a miniature scene within the snow globe, such as a city skyline, so that when the snow globe is shaken, there is the appearance of snow falling. Although a snow globe is commonly available, it only provides a decorative purpose and does not serve any other function.

In the patent literature, Bankert et al., U.S. Pat. No. 5,258,209 relates to a decorative device for displaying an ornamental object within a fluid. The device has the form of a transparent hollow bell-shaped enclosure. The interior of the enclosure contains a fluid and a plurality of small particles. A handle is attached to the crown of the enclosure. A fluid tight base is sealingly connected to the mouth of the enclosure.

Luu, U.S. Pat. No. 5,301,836, is directed to a liquid dispenser having a movable head as pump actuator, and an animal body for holding liquid.

Litton et al., U.S. Pat. No. Des. 318,794, provides an ornamental design for a combined bottle and cap; Dinand, U.S. Pat. No. Des. 365,020, relates to an ornamental design for a combined cosmetic container and cap; and Maddox, U.S. Pat. No. Des. 346,548, is directed to an ornamental design for a combined pump dispenser and cap.

Costa, U.S. Pat. No. Des. 352,234, and Kuzma, U.S. Pat. No. Des. 348,388, are each concerned with an ornamental design for a pump dispenser. Crawford, U.S. Pat. No. Des. 370,636, and Crawford, U.S. Pat. No. Des. 376,310, are each directed to an ornamental design for the body for a bottle.

Each of these patents provides either a dispenser or a fluid containing device for displaying an ornamental object within the fluid. None of these patents discloses or suggests a dispenser having a hollow decorative vessel for containing fluid and for displaying an ornamental object within the fluid that is matingly fitted to a reservoir which is capable of containing a liquid such as cleansing solution, with a dispensing apparatus that communicates between the hollow decorative vessel and the reservoir.

OBJECTS AND SUMMARY OF THE INVENTION

An object of the invention may include any of: providing a novel dispenser, providing a dispenser which in certain embodiments may be refillable, providing a dispenser which permits a wide range of design possibilities not dictated by the operation of the pump nozzle, providing a dispenser which is suitable for dispensing a cleansing solution such as shampoo or shower gel or the like, providing a dispenser which is aesthetically pleasing and thus encourages the user to refill and reuse it and thereby provide an environmental benefit, and, providing a dispenser having a hollow decorative vessel capable of containing a three dimensional ornamental decoration in a liquid which resembles a snow globe with a reservoir attached wherein the reservoir contains a desired liquid to be dispensed.

The invention is a dispenser having two connected vessels. One vessel contains the liquid to be dispensed. That vessel also provides a means for dispensing the contents of the first vessel, such as an open mouth bottle or tube covered by a cap, a pump dispenser mechanism or an aerosol type dispensing mechanism. This vessel can be refillable or a replaceable part of the dispenser. The second vessel is a hollow decorative vessel that is structured to permit a user to view a sculpture within the second vessel.

Thus, the invention provides a dispenser comprising a first vessel and a second vessel, wherein the first and second vessels are connected, the first vessel comprises means for dispensing a first liquid from its interior, and the second vessel comprises a hollow decorative vessel comprising means for permitting a user to view a sculpture within its interior.

The dispensing means of the first vessel can comprise an open mouth bottle or tube and a removable cover, or a pump dispenser mechanism or an aerosol. The open mouth bottle can be dispensed from by way of pouring, and the tube can be flexible such that liquid is dispensed therefrom by way of squeezing. The removable cover can be a snap-on type cover (with a receiving portion for the cover on the open mouth bottle or tube), or a threaded cap (with mating threads on the open mouth bottle or tube). Thus, as can be understood from this description, the vessels can be any desired shape.

The second vessel can contain a second liquid, and optionally particles capable of being temporarily in suspension when the second liquid is shaken or agitated.

The dispenser can further comprise means to dispense the first liquid passing through the second vessel. In this instance the dispenser can be constructed such that the first vessel is positioned below the second vessel.

The dispenser can be constructed such that the first vessel is positioned above the second vessel, and optionally there is no means for dispensing the first liquid which passes through the second vessel.

The dispenser can also be constructed such that the first and second dispensers are positioned adjacent each other, e.g., side-by-side (with side-by-side allowing for either of the vessels to also be above or below the other, that is that the arrangement next to each other can be skewered, for instance with one vessel higher or lower than the other vessel).

The dispenser can be constructed such that the first vessel is within the second vessel, or vice versa.

The dispenser can be constructed such that the means for permitting a user to view a sculpture within its interior comprises the second vessel being clear or transparent or translucent.

The dispenser can also be constructed such that the means for permitting a user to view the sculpture within its interior comprises the second vessel being translucent and having frosting (e.g., a white or other color tinting or speckling) or a color imparted to the second vessel.

The dispenser can also be constructed such that the means for permitting a user to view a sculpture within its interior comprises a the second vessel having discrete portions, wherein at least one first portion allows for viewing of the sculpture and at least one second portion does not permit for viewing of the sculpture. In other words, the second vessel can have one or more "windows" which allow the user to view the sculpture. The windows can be clear or transparent or translucent or colored or frosted. And, the second vessel can additionally have one or walls "walls", through which the sculpture cannot be viewed by the user.

The first vessel can be refillable or replaceable.

Additionally, the invention provides a method for dispensing a liquid from a dispenser comprising providing a dispenser comprising a first vessel and a second vessel, wherein the first and second vessels are connected, the first vessel comprises means for dispensing a first liquid from its interior, and the second vessel comprises a hollow decorative vessel comprising means for permitting a user to view a sculpture within its interior, and dispensing liquid from the dispensing means.

The invention also provides a dispenser comprising a hollow decorative vessel capable of containing a first liquid. The vessel has an upper end and a lower end. The decorative vessel is connected to a reservoir capable of containing a second liquid. The reservoir has an interior, an exterior and an upper end having means defining an opening.

The dispenser further comprises a base member positioned at the lower end of the hollow decorative vessel and having a sealed connection with the reservoir at the upper end where the opening of the reservoir is, such that the decorative vessel is positioned above the reservoir. The hollow decorative vessel further has means passing through it communicating with the interior of the reservoir and maintaining a seal between the reservoir and the decorative vessel, so as to prevent mixture of the first and second liquids.

The hollow decorative vessel also has pumping means positioned at its upper end and passing through the communicating means into the interior of the reservoir so that the second liquid in the reservoir may be dispensed from the upper end of the vessel.

The communicating means can comprise a sleeve passing from the upper end to the lower end of the vessel, through the base member.

In another embodiment, the communicating means can comprise a sleeve having a member connected to the base member and projecting upwardly to the pumping means.

The pumping means can include a dispensing tube and an actuator, with the actuator positioned at the upper end of the hollow decorative vessel, and the dispensing tube connected to the actuator and passing through the sleeve into the interior of the reservoir.

The actuator can be removable, allowing for refilling of the reservoir through the sleeve.

There can be a gasket at the connection of the base member and the sleeve, or a threaded connection that provides a seal to the reservoir.

The sealed connection to the reservoir can be removable, allowing for filling or refilling of the reservoir through the upper end opening of the reservoir.

The reservoir can include a decorative covering.

The base member can include means defining an opening, and a closure therefor, allowing for filling or refilling of the vessel with the first liquid and of the reservoir with the second liquid and prevention of admixture of the first and second liquids.

The hollow decorative vessel can be globe-shaped or bell-jar shaped and have a decorative three-dimensional object positioned within it in surrounding relationship to the communicating means.

The first liquid can include insoluble material small particulate matter, for example capable of being in suspension for a period of time within the first liquid, when the first liquid is agitated (or when the dispenser is shaken).

The invention further provides a method of dispensing a liquid comprising providing an inventive dispenser, actuating the pumping means, and dispensing the second liquid from the reservoir.

The present invention can function as identifying the source or origin of the product, to distinguish the product from those of others, and, to convey an image.

The present invention can also provide a dispenser with a generally cylindrical vessel with a dome top akin to a bell jar. Particularly, it can resemble a snow globe including a liquid with particles of white "snow", yet it is both functional and aesthetically pleasing.

The present invention can meet the need for expanding the range of dispenser designs by providing a pump dispenser wherein the activator is attached to the hollow decorative vessel that is connected to the fluid-containing reservoir.

The present invention provides a novel dispenser having a decorative device for displaying an ornamental object and a reservoir for containing a liquid that can be, but is not limited to a cleansing solution.

Moreover, as shown by considering all of the embodiments depicted and described, the invention provides a dispenser comprising a hollow decorative vessel capable of containing a first liquid and preferably containing a decorative element, a reservoir connected to the hollow decorative element and capable of containing a second liquid and having an interior therefore, and means for dispensing the second liquid from the interior of the reservoir.

The hollow decorative element can be atop or below or adjacent the reservoir, or surrounded by the reservoir, or can contain the reservoir.

The dispensing means can be a screw cap assembly for pour dispensing, or a pump dispenser for pump dispensing, or an aerosol dispensing means for spray dispensing (which the reservoir is an aerosol container, which can also be replaceable). Similarly, the dispenser can be refillable in pour dispensing or pump dispensing embodiments, or replaceable.

And, the hollow decorative vessel can contain the first liquid and particles capable of being temporarily in suspension when the first liquid is shaken or agitated.

These and other objects and embodiments of the invention are provided in, or are obvious from, the following detailed description.

BRIEF DESCRIPTION OF THE DRAWINGS

In the following detailed description, reference will be made to the accompanying drawings, wherein.

DETAILED DESCRIPTION

Reference is made to all of the figures wherein as preferred embodiments, dispensers 100, 200 and 300 are illustrated.

As will be appreciated from the following, dispensers 100, 200 and 300 are pump dispensers. Each has a hollow decorative vessel atop a reservoir, with the actuator positioned at the upper end of the hollow decorative vessel. A dispensing tube is connected to the actuator and runs from the actuator into the reservoir. The dispensing tube thus allows for "communication" between the reservoir and the actuator. The dispensing tube is surrounded by the hollow decorative vessel.

The hollow decorative vessel can contain a first liquid, and the reservoir can contain a second liquid, with sealing means between the hollow decorative vessel and the reservoir such that there is substantially no admixture of the first and the second liquids. The first liquid can contain particles which can be in suspension for a period of time when the first liquid is shaken, such that the hollow decorative vessel can be like a "snow globe" atop the reservoir. Thus, dispensers 100, 200 and 300 are aesthetically pleasing dispensers.

Figure 1:
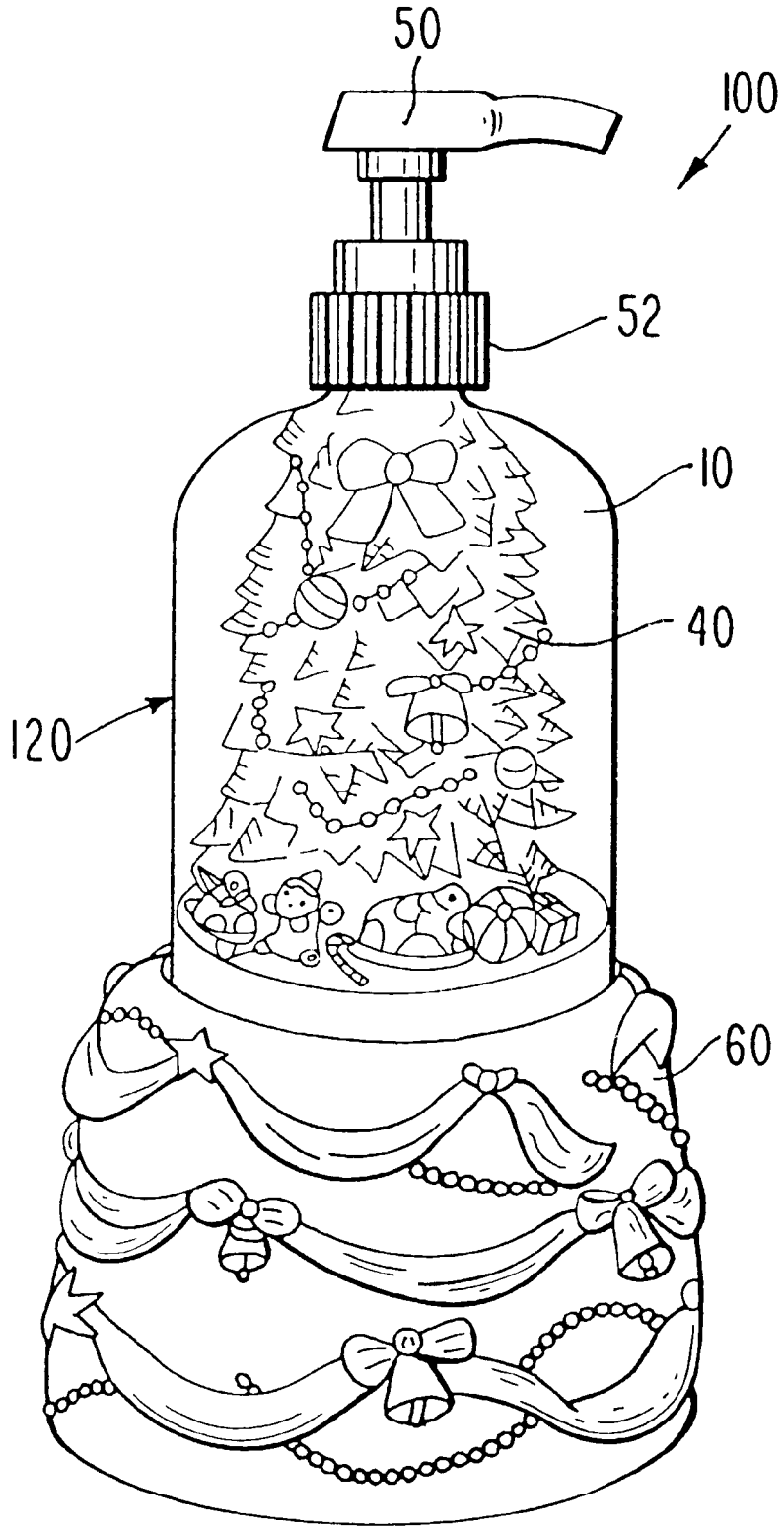
FIG. 1 shows a front elevation view of an embodiment of the invention.
Figure 2:
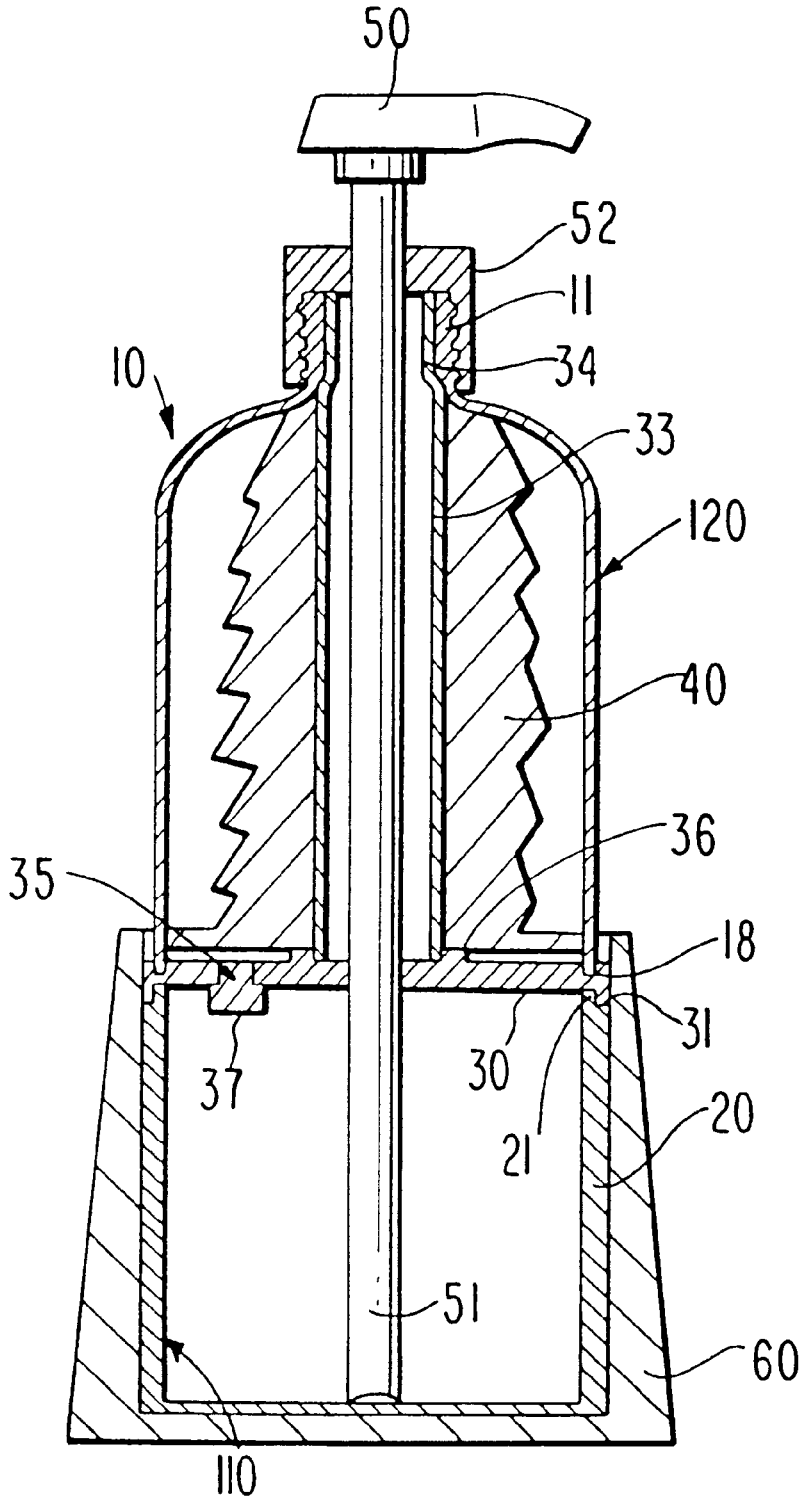
FIG. 2 shows a cross-section view of an embodiment of the invention.
Figure 3:
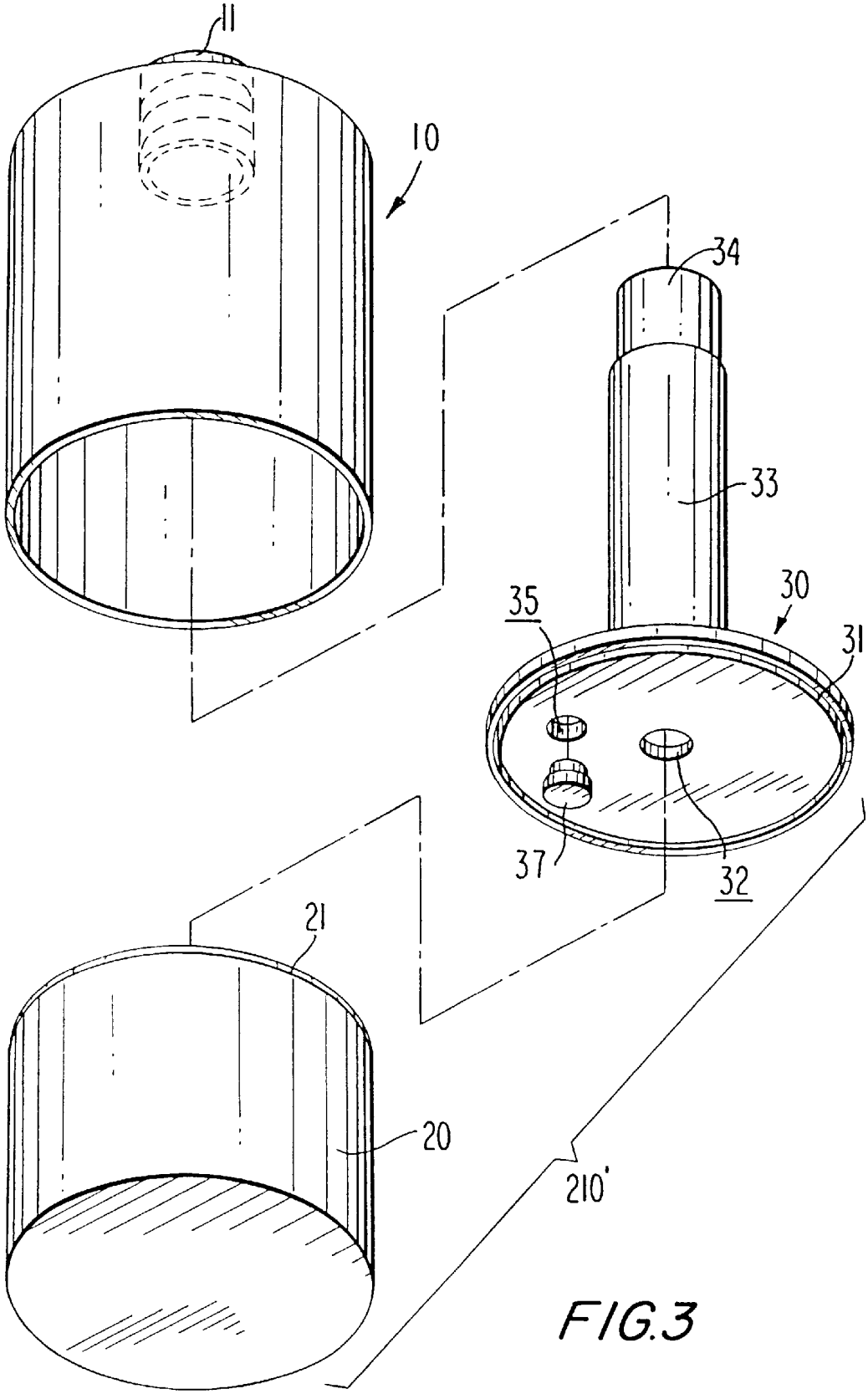
FIG. 3 shows an exploded view of an embodiment of the invention.

Referring to FIGS. 1 to 3, dispenser 100 has globe 120 including a hollow transparent decorative vessel 10 capable of containing a first liquid and a three dimensional decorative element 40. At the upper end of globe 120 is actuator 50. The decorative element 40 can any seasonal decoration. The hollow transparent decorative vessel 10 resembles a glass jar and is generally cylindrical with a dome top, akin to a bell jar.

More specifically, hollow decorative vessel 10 has a first end at its top and a second end at its bottom. The first end is tapered, and the tapered end of the hollow decorative vessel has an interior surface and an exterior surface. The exterior surface of the tapered end has a threaded member 11 to receive a threaded sleeve 52 which fastens actuator 50 to the top of hollow transparent decorative vessel 10. At the bottom of hollow decorative vessel 10 is a base member 30 which is positioned over reservoir 20, such that the hollow decorative vessel 10 is atop reservoir 20. A decorative covering 60 can be fitted over reservoir 20 to further enhance the overall appearance of the dispenser.

Figure 4:
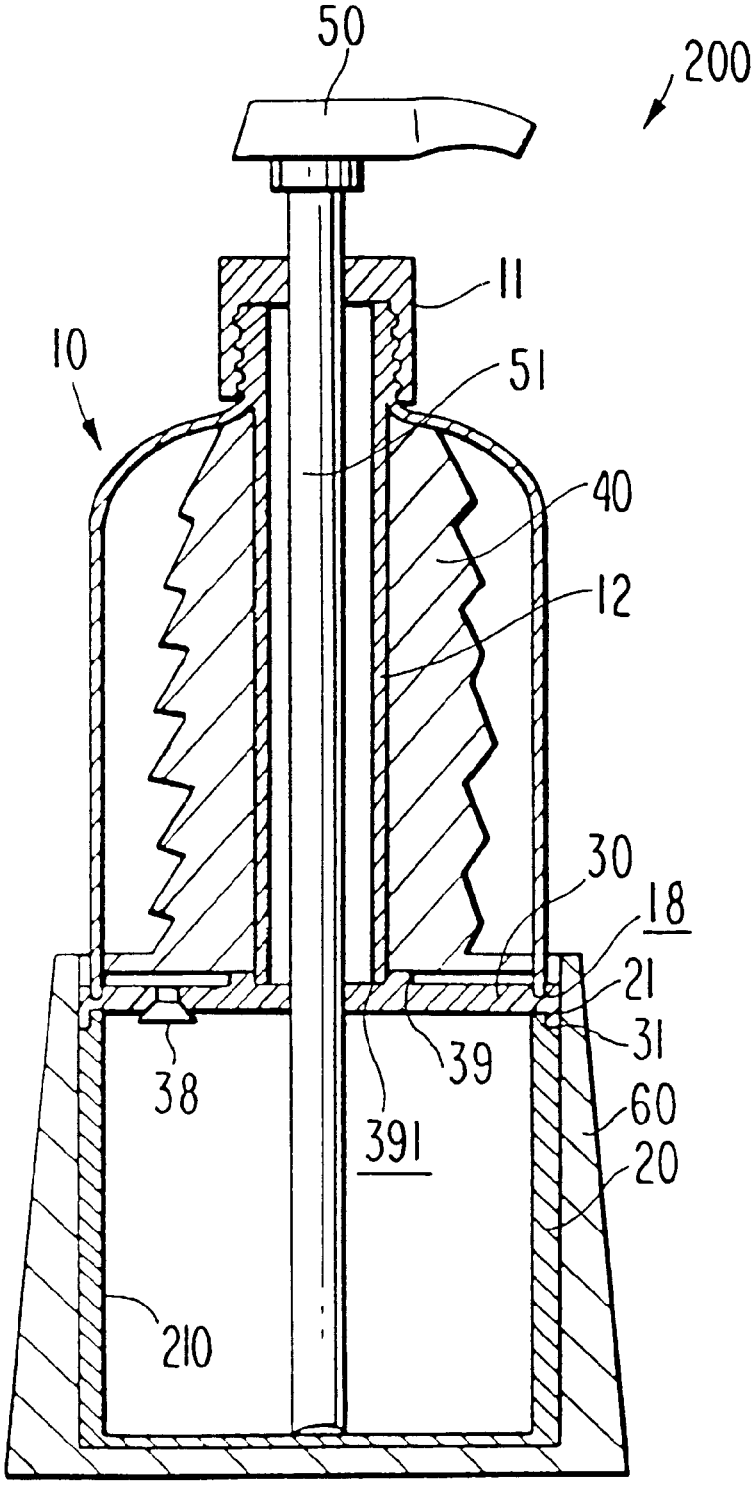
FIG. 4 shows a cross-section view of a second embodiment of the invention.
Figure 6:
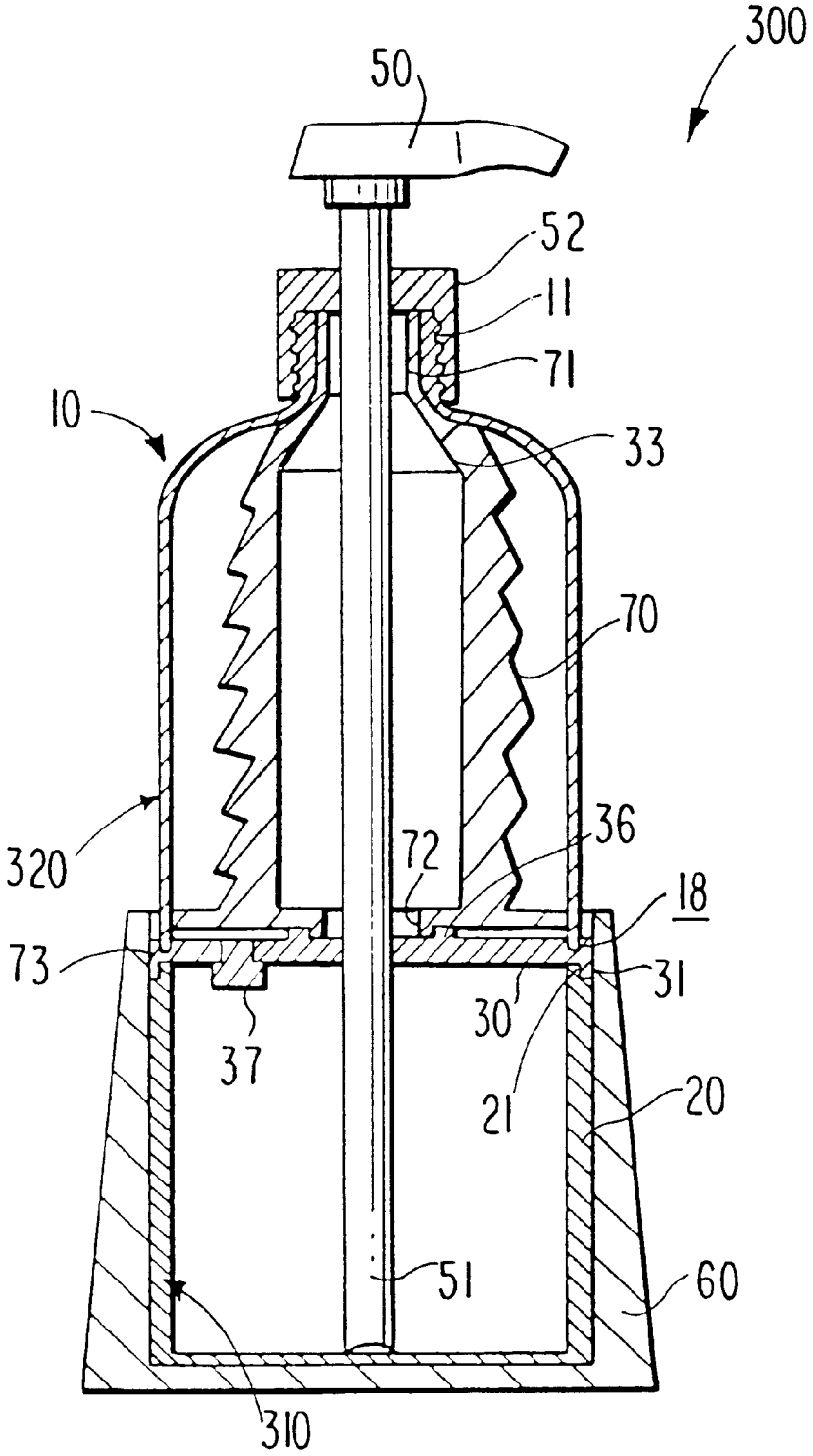
FIG. 6 shows a cross-section view of a third embodiment of the inventions

Referring to FIGS. 2, 4 and 6, dispenser 100, 200 and 300 includes an actuator 50 connected to a dispensing tube 51 which communicates between the actuator 50 and the interior 110 of reservoir 20. The dispensing tube 51 passes within globe 120. Thus, globe 120 may be considered to further comprise a cylinder 120A through which dispensing tube 51 concentrically passes, decorative vessel 10 positioned concentrically over cylinder 120A such that vessel 10 is sealed from cylinder 120A and contains area 120B, wherein area 120B contains the first liquid and three dimensional decorative element 40. Globe 120 can be matingly-fitted to reservoir 20 via base member 30.

Referring to FIGS. 2 and 3, cylinder 120A is formed from sleeve 33 within globe 120. Sleeve 33 has a first end at its top and a second end at its bottom. The first end terminates at cylindrical member 34 which has a smaller outer diameter than sleeve 33 and matingly-fits to the interior surface of threaded member 11. The second end of sleeve 33 extends downwardly toward the second end of the hollow decorative vessel 10. Thus, sleeve 33 is generally cylindrical in shape, and defines cylinder 120A as an opening to receive the dispensing tube 51 and allow it to pass within the hollow decorative vessel 10. The second end of the sleeve 33 joins base member 30. The connection of sleeve 33 and base member 30 is sealed via gasket 36. The base member 30 has a threaded upper surface 18 which matingly-fits to the second end of the hollow decorative vessel 10. Thus, sleeve 33 has a member 34 and is connected to the base member and projects upwardly to the pumping means. Base member 30 also has a threaded lower surface 31 and an intake opening 35. Intake opening 35 allows the hollow transparent decorative vessel 10 to receive liquid or solids. A stopper 37 is matingly-fitted to the intake opening 35 of the base member 30 to create a water-tight seal.

The threaded lower surface 31 of the base member 30 is matingly-fitted to a threaded surface 21 at the top of reservoir 20. The reservoir 20 has interior 110 adapted to contain a second liquid which is to be dispensed through dispensing tube 51 and actuator 50 (Actuator 50 being pump dispensing means such that when depressed by a user, the second liquid rises within dispensing tube 51 and is dispensed through actuator 50). Reservoir 20 has an exterior surface which can be adapted to receive decorative covering 60.

Considering particularly FIG. 3, the combination of threaded member 11, vessel 10, member 34, sleeve 33, base 30, and reservoir 20, is assembly 210'.

Figure 5:
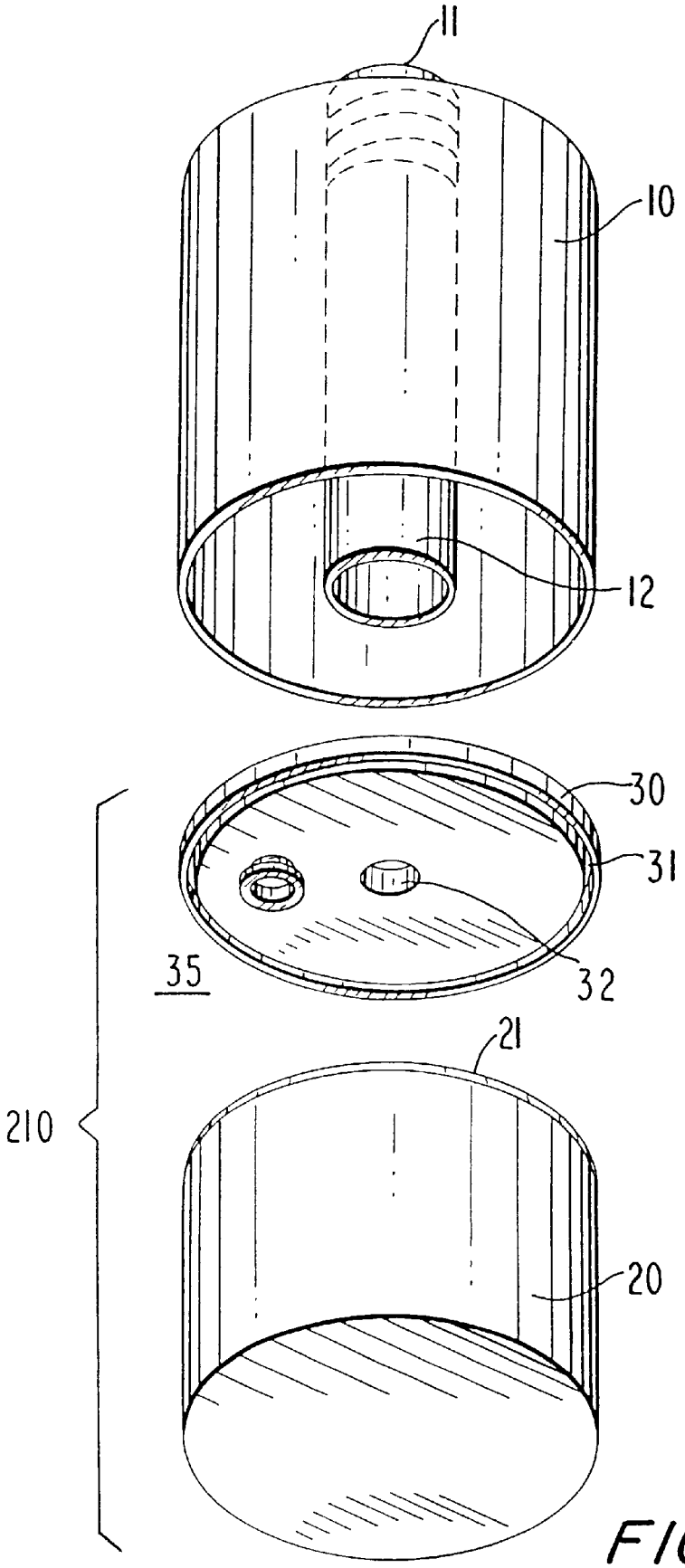
FIG. 5 shows an exploded view of the second embodiment of the invention.

Referring to FIGS. 4 and 5, dispenser 200 is similar to dispenser 100, except that the member 34 and sleeve 33 are replaced by tubular member 12 (which fits into threaded member 11), base member 30 has an opening 391 with a convex threaded member 39 that is matingly-fitted to the tubular member 12 and the stopper 37 is replaced with a water resistant filler material 38 to create a water tight seal between the base member and the second end of the hollow decorative vessel so as to prevent the admixture of the first liquid with the second liquid.

The combination of threaded member 11, vessel 10, sleeve 12, base 30 and reservoir 20 is assembly 210.

Figure 7:
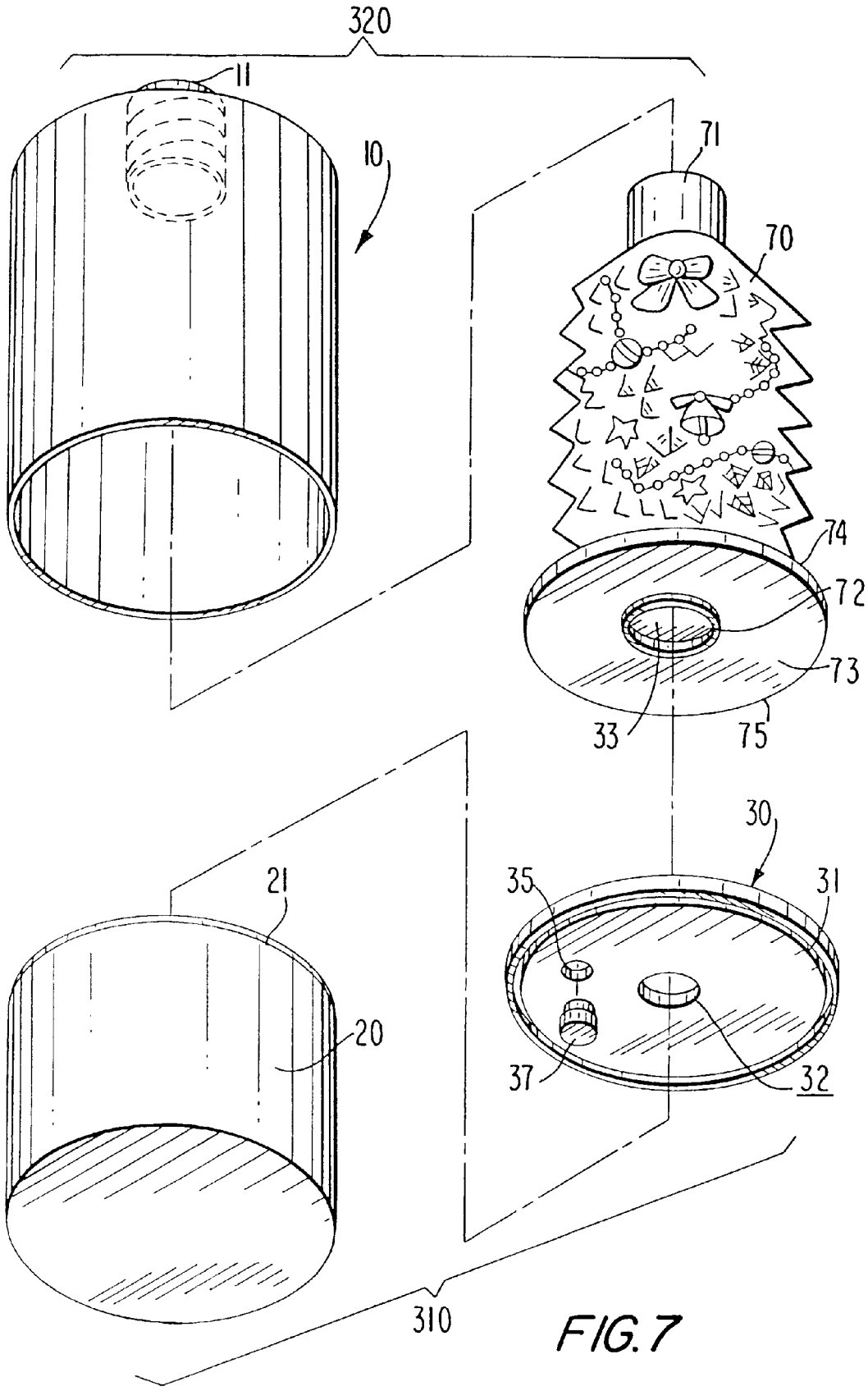
FIG. 7 shows an exploded view of the third embodiment of the invention.

Referring to FIGS. 6 and 7, dispenser 300 is similar to dispenser 100, except that cylinder 120A truncates at the upper end with sleeve 33 mating into threaded member 11, sleeve 33 is matingly-fitted to opening 32 of the base member 30, and sleeve 33 is surrounded by a three dimensional decorative element 70. The three dimensional decorative element 70 further comprises a first end 71 at the top of three dimensional decorative element 70 and a second end at the bottom of three dimensional decorative element 70. The first end 71 is tapered to fit inside the interior surface of the threaded member 11. The second end of the three dimensional decorative element is attached to base 73 having a bore 72 which is preferably the same dimension as the opening 32 of the base member 30.

The base 73 has a threaded upper surface 74 and a threaded lower surface 75. The threaded upper surface 74 is matingly-fitted to the second end of the hollow decorative vessel to form a tight seal whereas the threaded lower surface 72 of the base 73 is matingly-fitted to the threaded upper surface 18 of the base member 33.

The combination of threaded member 11, vessel 10, element 70, base 30 and reservoir 20 is assembly 310.

The hollow decorative vessel 10 can be transparent or opaque, it can be made from any material that is moldable and yet provides rigidity. Thus, it can be glass or plastic or any suitable synthetic material. Preferably, vessel 10 is formed from clear or transparent plastic. The hollow decorative vessel can be manufactured by any process such as molding, injection molding, blow molding and injection molding.

Likewise, the reservoir, is preferable formed from a substantially rigid material, including metal, glass, plastic and thermoplastic, and is preferably polypropylene. This component can be manufactured by any processes such as molding, injection molding, blow molding and injection blow molding, preferably injection molding.

The remaining components of the dispenser can also be formed from any suitable material. Preferably these components are formed from plastics and are made by molding, e.g., injection molding, blow molding or injection blow molding.

The first liquid contained within the hollow decorative vessel can be water or an oil. Preferably the first liquid within the hollow decorative vessel is a liquid having a clear and transparent quality. But, it can also be colored. The first liquid also preferably contains insoluble material capable of being in suspension for a period of time when the first liquid is agitated or shaken.

Thus, the hollow decorative vessel 10 contains the first liquid, the three dimensional decorative element 40 and a multiplicity of particles disposed within the first liquid, such that the hollow decorative vessel resembles a snow globe. Therefore, when an user shakes the hollow decorative vessel (or the dispenser), the multiplicity of particles inside the hollow decorative vessel 10 will move harmoniously with the first liquid, and through the movement of the first liquid, the particles will slowly descend, thus resembling snowing. This is aesthetically pleasing and highly decorative.

The second liquid within the reservoir can be lotion, shower gel, liquid soap, shampoo, conditioner, creams, oil, perfume, cologne, or any other household liquid.

The dispenser can be sized as desired. For example, the dispenser is preferably sized so it is suitable for display on a shelf or a sink (e.g., a bathroom sink), or for use in the home. For instance, it can have a diameter of about four inches and a height of about seven inches.

Thus, the dispenser has a hollow decorative vessel and a reservoir to contain liquid to be dispensed. The hollow decorative vessel is positioned above the reservoir, and can be removable from the reservoir to facilitate refilling the reservoir. The hollow decorative vessel can contain a fluid and insoluble material capable of being in suspension for a period of time when the dispenser is shaken, such that the hollow decorative vessel can have a "snow globe" appearance. Accordingly, the dispenser is aesthetically pleasing and therefore invites the user to reuse it, rather than dispose of it, thereby presenting environmental advantages over previous dispensers.

The dispenser is used by the user depressing the actuator, which is a pump dispensing means, which forces liquid in the reservoir to rise within the dispensing tube and be dispensed from the actuator. When the reservoir is empty, the user may refill it by unscrewing the actuator and pouring liquid into cylinder 120A and into the reservoir. And, if there is a loss or evaporation of the first liquid in the decorative vessel, by means of stopper 37 or 38, the user may refill or add to the decorative vessel.

Considering further FIGS. 8 to 17, showing dispensers 400, 500, 100', 600, 700, 800, 900, 1000, 1100, and 1200, components analogous to those shown in FIGS. 1 to 7 are provided with a reference number having prime (') or double prime (") or alphabetical designation.

Figure 9:
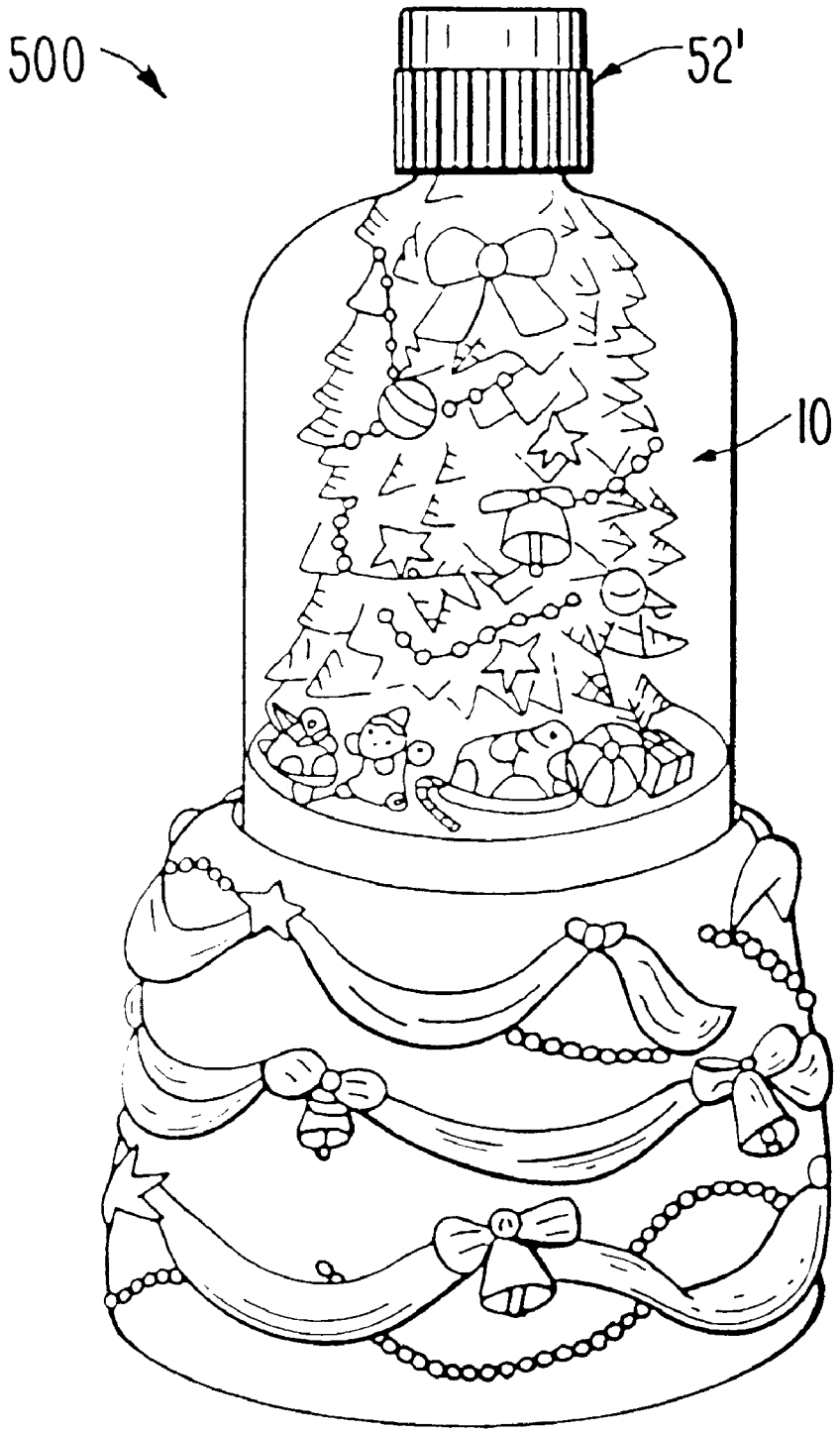
FIG. 9 shows a front elevation view of a fifth embodiment of the invention.

For instance, in FIG. 9, dispenser 500 is analogous to the dispensers shown in FIGS. 1 to 7, except that instead of the dispensing mechanisms shown therein, dispenser 500 has screw top 52' for dispensing liquid by pouring from the reservoir. Thus, liquid from the reservoir would flow through the sleeve and pour out from the top, when screw top 52' is removed.

Figure 10:
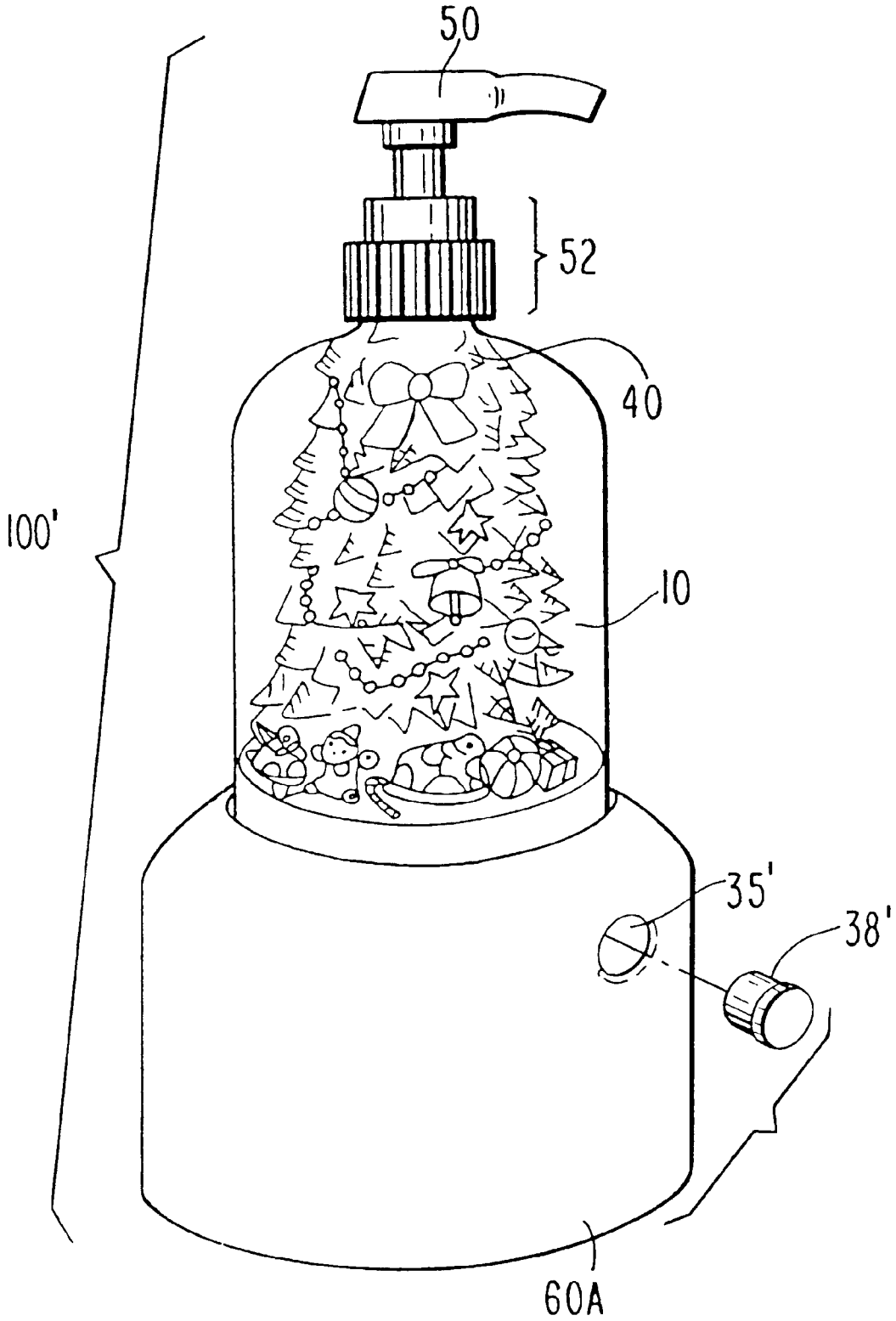
FIG. 10 shows a front elevation view of a sixth embodiment of the invention.

Similarly, dispenser 100' in FIG. 10 is analogous to the dispensers of FIGS. 1 to 7, except that instead of refilling from the top of the dispenser, or from an opening in the base member, dispenser 100' is provided with a refilling port 35' on the side of the reservoir (as opposed to the top in earlier described embodiments), accessible near the top of decorative covering 60A. Removable plug member 38', which can be a screw with a gasket, seals refilling port 35', for when dispensing is desired.

Figure 8:
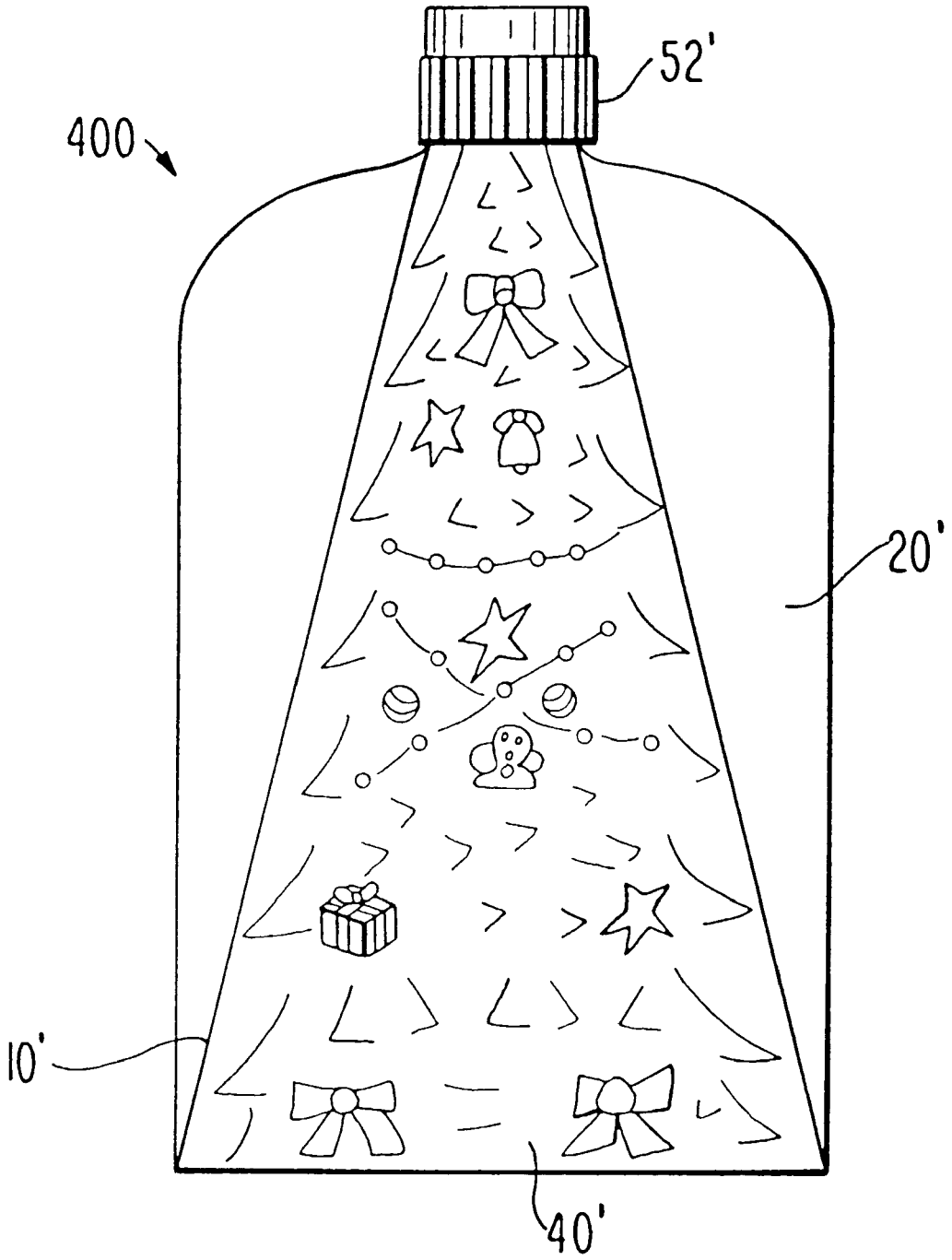
FIG. 8 shows cross-section view of a fourth embodiment of the invention.

In FIG. 8 is shown dispenser 400 wherein reservoir 20' is in surrounding relation to decorative vessel 10' containing decorative element 40'. The reservoir terminates with a screw cap assembly 52' for dispensing by pouring.

Figure 11:
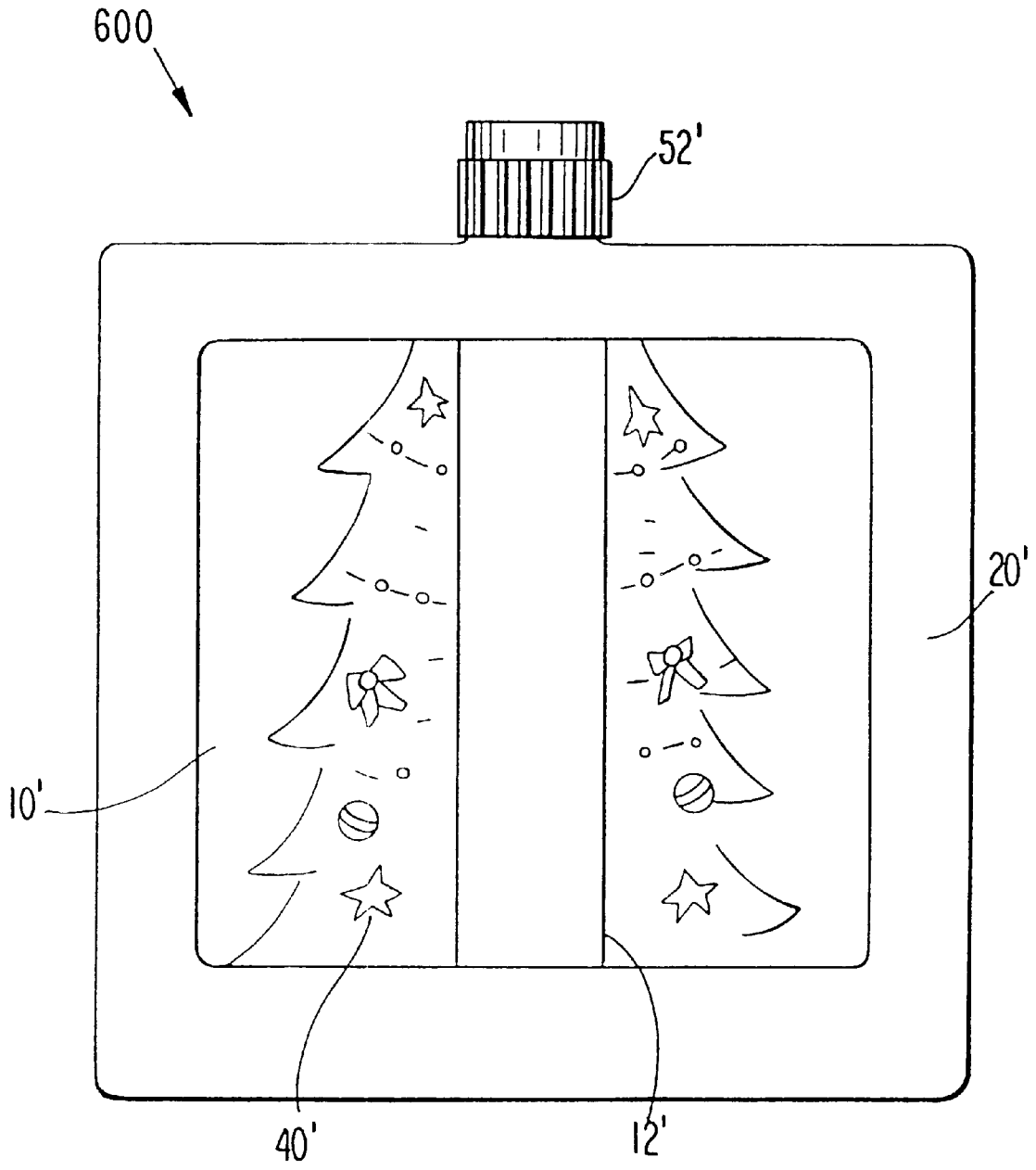
FIGS. 11 to 17 show cross-section views of additional embodiments of the invention.

Dispenser 600 in FIG. 11 is analogous to dispenser 400 of FIG. 8, except that the surrounding relationship includes having reservoir 20' have a portion beneath decorative vessel 10'. That is, reservoir 20' is above, below and around the decorative vessel 10'. In the embodiments of FIGS. 8 and 11, the reservoir is preferably translucent or transparent, as is the liquid within it, so as to permit viewing of decorative vessel 10' and decorative element 40'.

Each of dispensers 400 and 600 can be configured to be a pump dispenser, as further alternative embodiments. Thus, FIG. 11 includes optional sleeve 12' running from screw cap assembly 52' to a lowest portion of reservoir 20', so that instead of a screw cap, a pump dispensing means (see FIGS. 1 to 7) can be affixed to the top of the dispenser, for dispensing liquid from the reservoir 20'. Similarly, in the embodiment of FIG. 8, reservoir 20' can extend to beneath decorative vessel 10'. In such a further alternative embodiment, the optional sleeve 12' of FIG. 11 can be provided too, such that the screw cap can also be replaced with pump dispensing means for dispensing liquid from the reservoir 20'.

Figure 12:
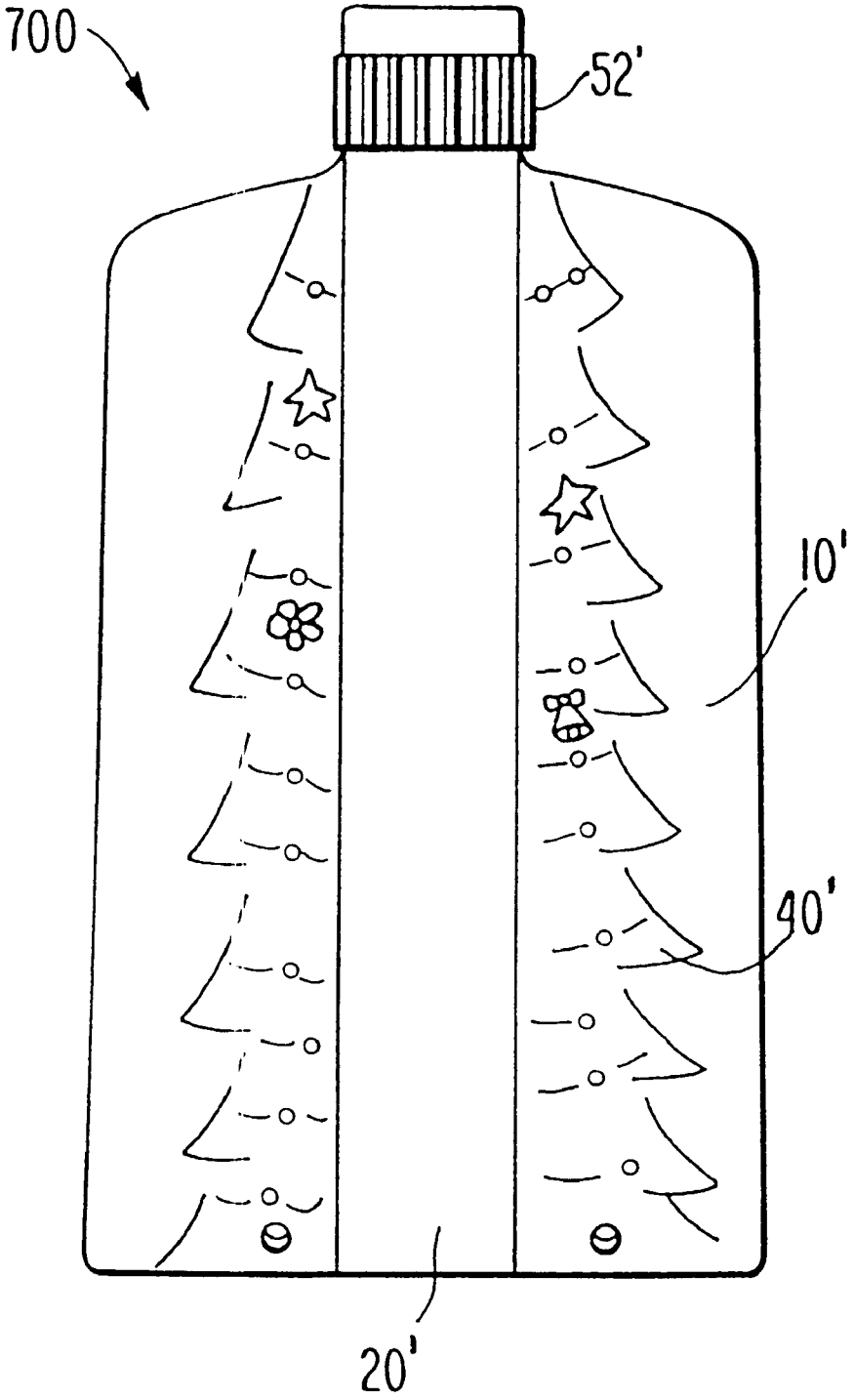
Figure 15:
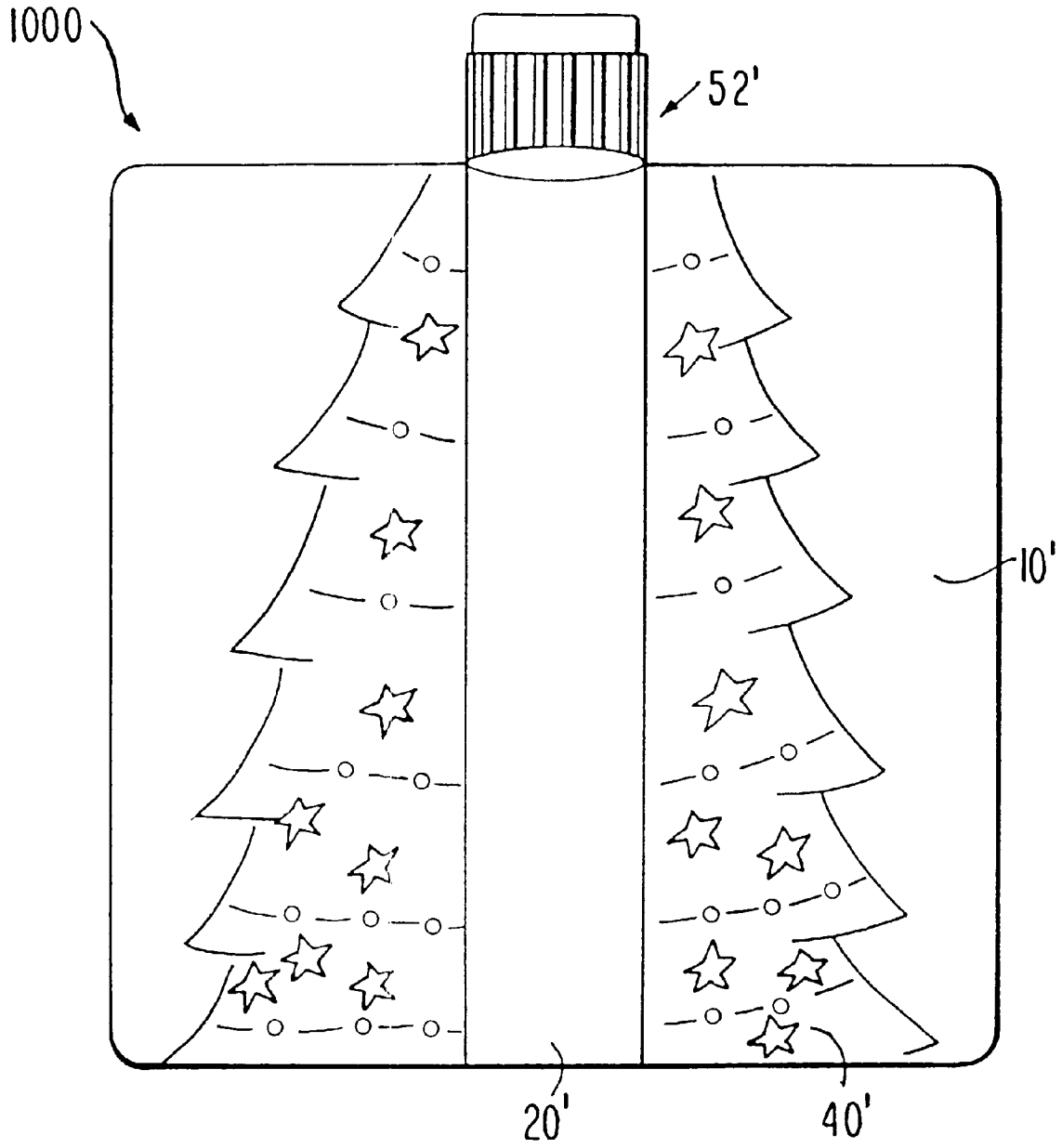

FIGS. 12 to 1 show alternative embodiments 700 to 1200 wherein reservoir 20' is positioned within decorative element 40'. FIGS. 12 and 15 show dispensers 700 and 1000 wherein decorative vessel 10' surrounds decorative element 40', and decorative element 40' contains reservoir 20' within the interior of decorative element 40'. Each of dispensers 700 and 1000 contain a screw cap assembly 52' at the top, in communication with reservoir 20', for dispensing by pouring. Dispensers 700 and 1000 of FIGS. 12 and 15 differ in that dispenser 700 is somewhat bell jar shaped whereas dispenser 1000 is somewhat square or rectangular shaped (corners can be rounded), akin to the shapes of dispenser 400 and 600 of FIGS. 8 and 11 (showing that dispensers of the invention can be of any desired shape).

Figure 13:
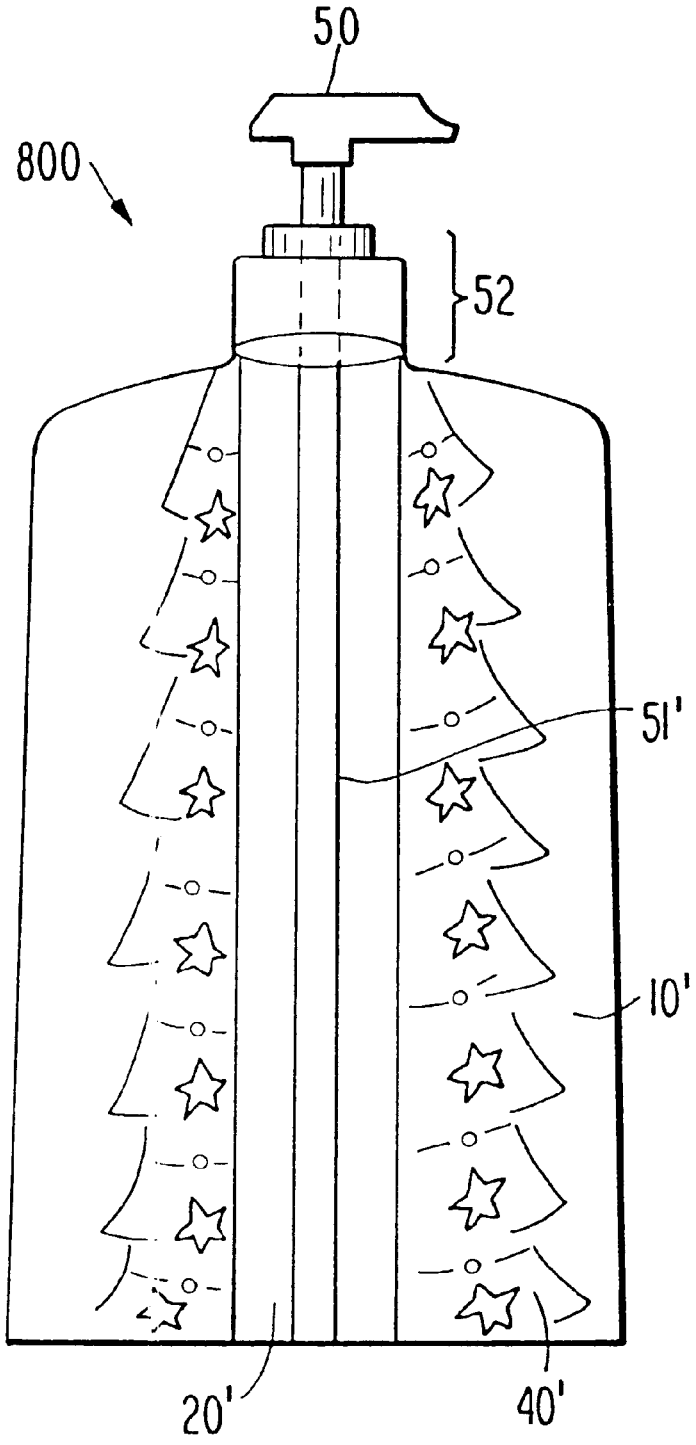
Figure 16:
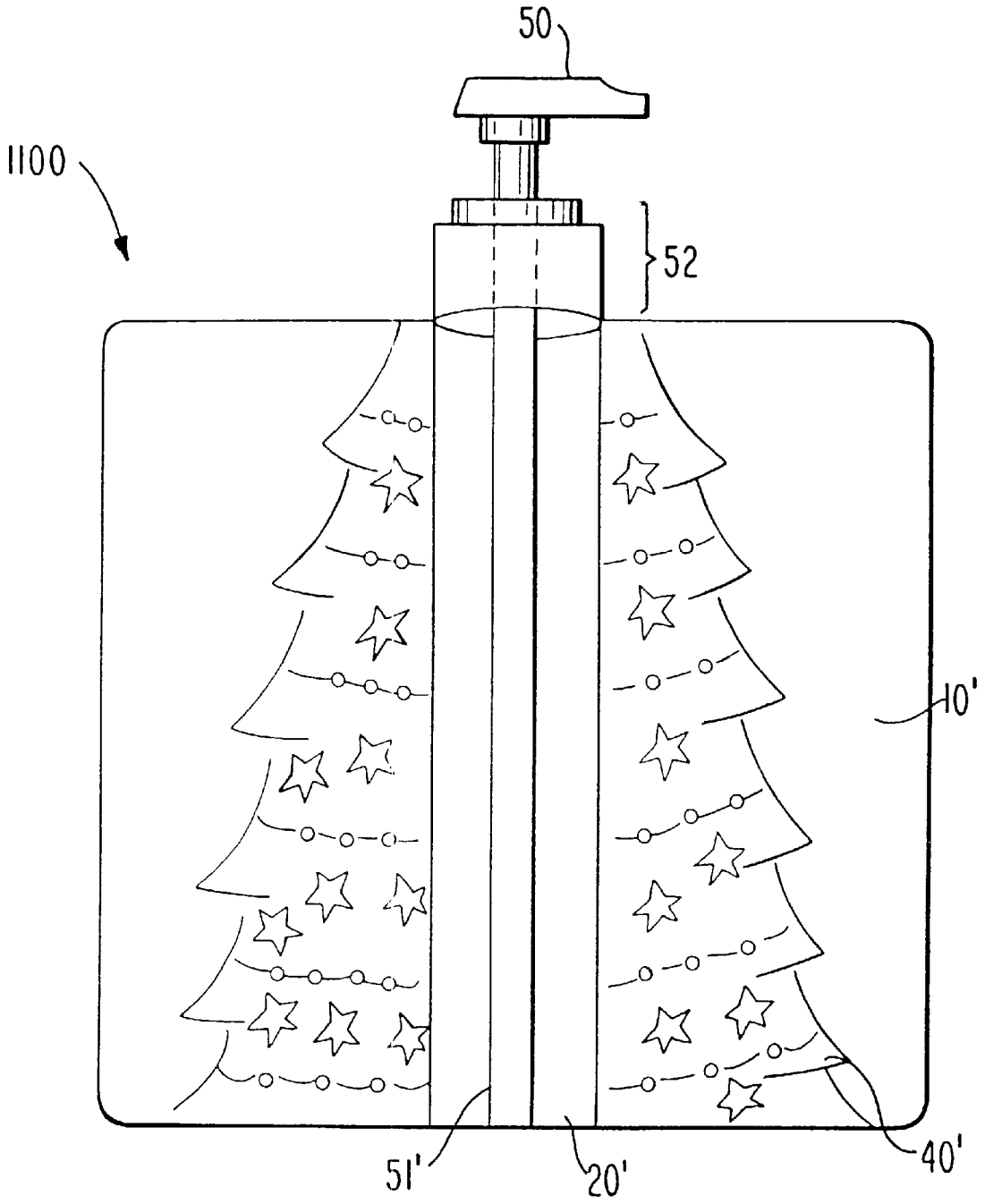

Dispensers 800 and 1100 of FIGS. 13 and 16 are analogous to dispensers 700 and 1000 of FIGS. 12 and 15, except that instead of screw cap assembly 52' at the top, in communication with reservoir 20' of each of dispensers 800 and 1100 is a pump dispensing assembly comprising dispensing tube 51 extending to a lowest portion of reservoir 20' connected to actuator 50 which is fastened to the top of the dispenser by threaded sleeve 52, for dispensing by pump dispensing, analogous to the embodiments of FIGS. 1 to 7 and 10, and alternatives for embodiments of FIGS. 8 and 11.

Figure 14:
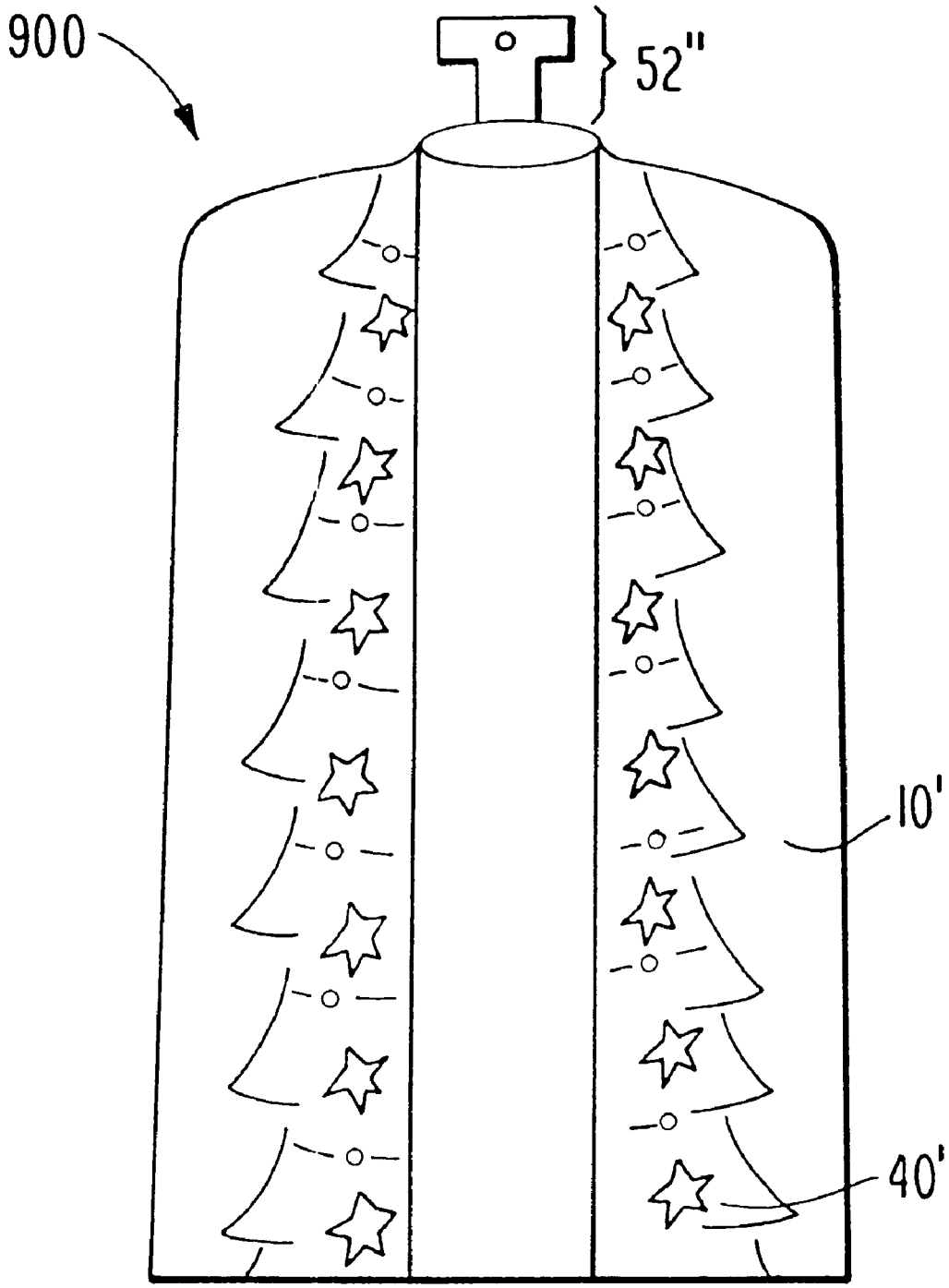
Figure 17:
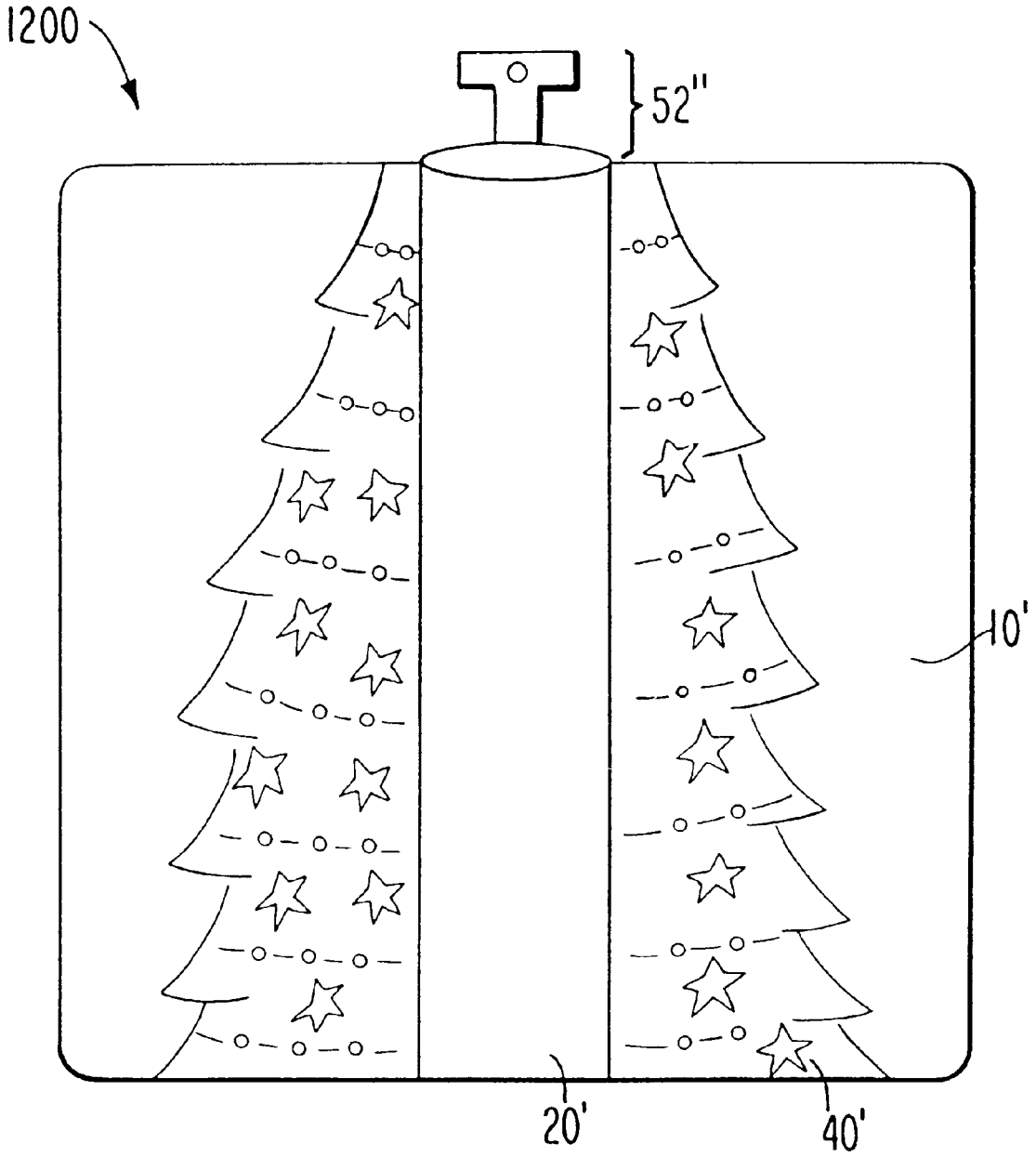
Figure 18:
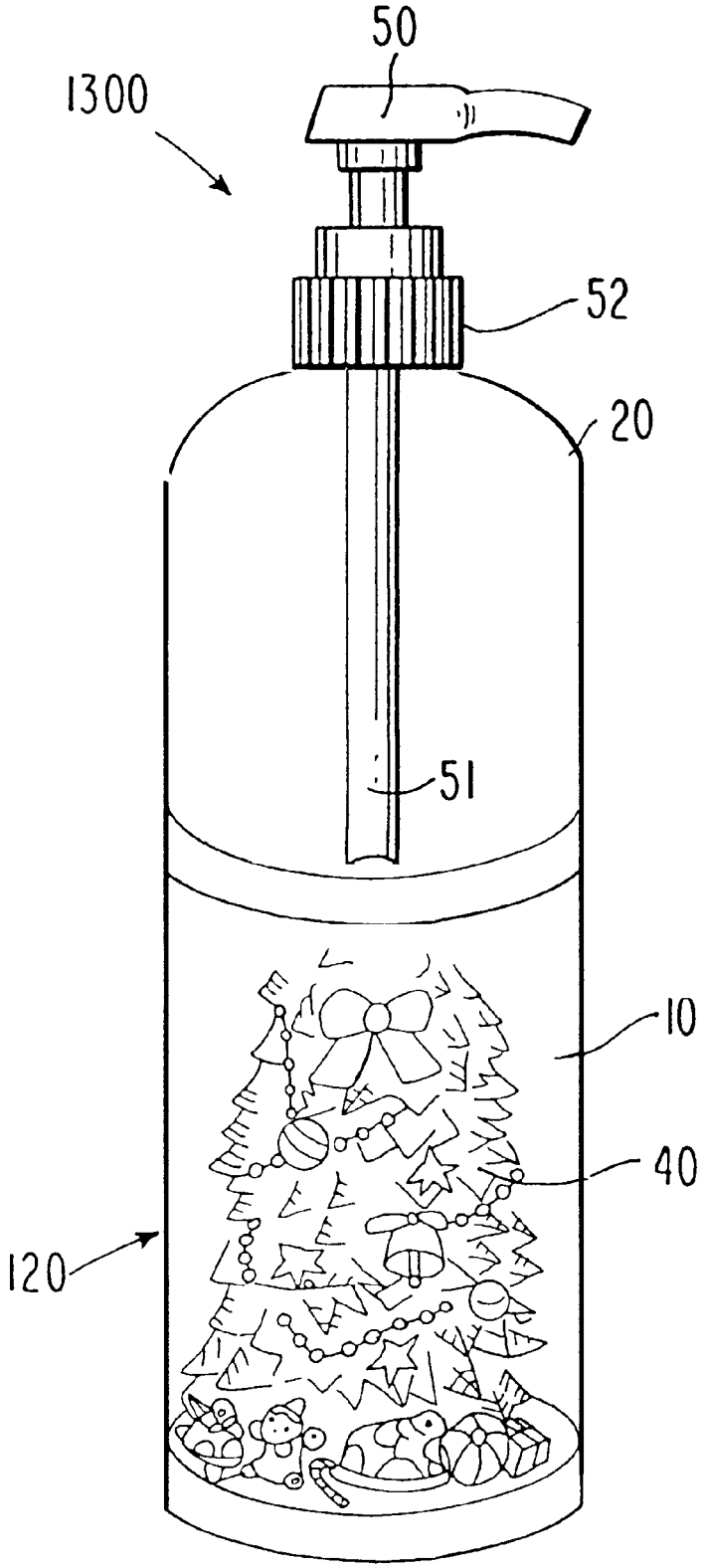
FIG. 18 shows a front elevation view of a thirteenth embodiment of the invention.
Figure 19:
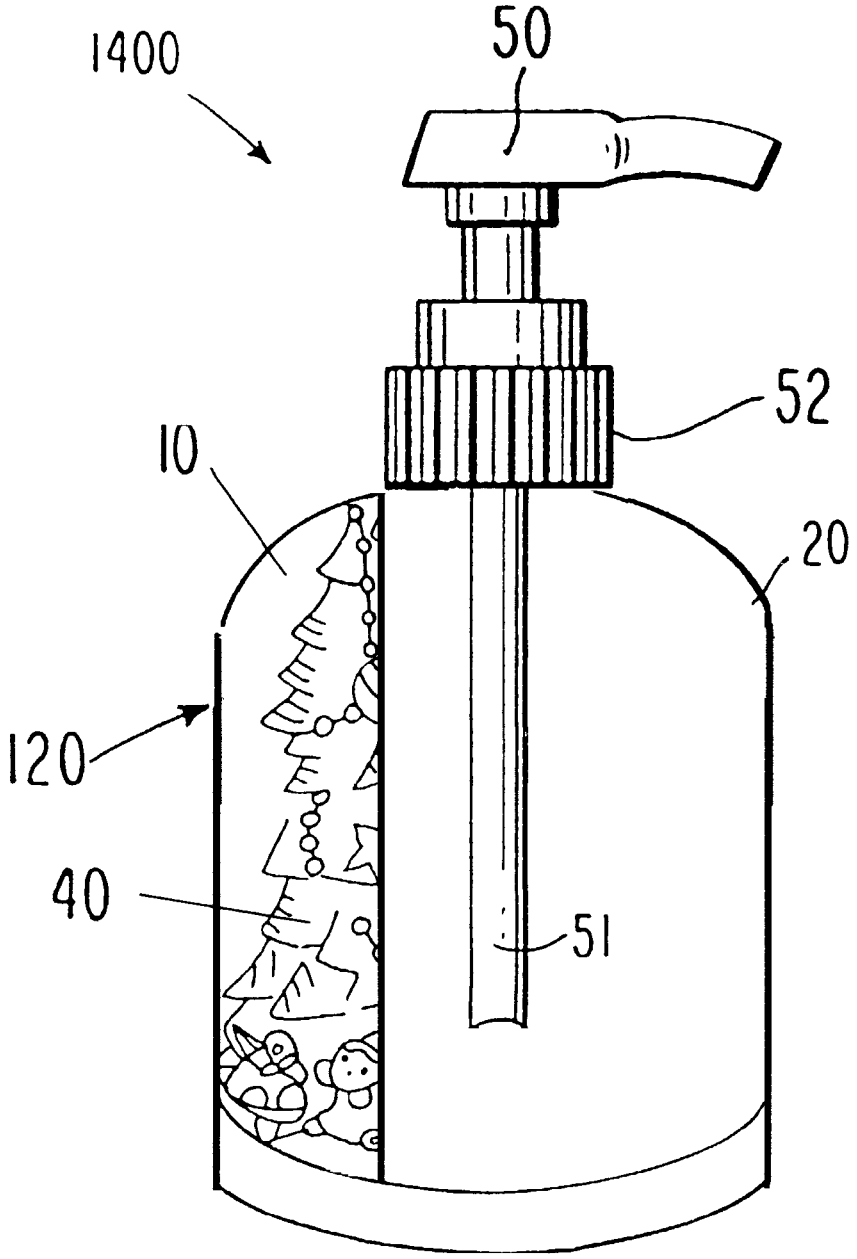
FIG. 19 shows a front elevation view of the fourteenth embodiment of the invention.

And, dispensers 900 and 1200 of FIGS. 14 and 17 are analogous to dispensers 800 and 1100 of FIGS. 13 and 16, except that reservoir 20' and the pump dispensing assembly are replaced by aerosol reservoir 20" terminating at its top portion with aerosol dispenser/actuator 52". Thus, the reservoir and dispensing means in embodiments of the invention can alternatively be an aerosol dispenser, for example, an aerosol can.

Furthermore, considering the various figures, for example, FIGS. 1 to 7, 9 and 10, and alternatives for embodiments of FIGS. 8 and 11, it should be understood that the reservoir can also be positioned atop the decorative vessel. In other words, considering the various embodiments as shown for example in FIGS. 1 to 7, 9 and 10, the reservoir can be positioned atop the decorative vessel, with the reservoir being an aerosol dispenser, or a pump dispenser (with communicating means running through the decorative vessel eliminated) with pump dispensing means (e.g., dispensing tube, actuator and fastening means for the actuator) connected to the reservoir, or a pour dispenser with a screw cap assembly atop the reservoir.

Moreover, as shown by the foregoing, in its broadest sense, the invention can comprehend a dispenser comprising a hollow decorative vessel preferably containing a decorative element and capable of containing a first liquid, a reservoir connected to the hollow decorative vessel and capable or containing a second liquid and having an interior therefor, and means for dispensing the second liquid from the interior of the reservoir. The hollow decorative element can be above or below the reservoir, or surrounded by the reservoir, or can contain the reservoir. The dispensing means can be a screw cap assembly for pour dispensing, or a pump dispenser for pump dispensing, or can be an aerosol dispensing means for spray dispensing (whereby the reservoir is an aerosol container). And, the hollow decorative vessel can contain the first liquid and particles capable of being temporarily in suspension when the first liquid is shaken or agitated.

The decorative element 40 or 40' can any seasonal decoration. For instance, decorative element 40 or 40' can have a Christmas-tree like appearance. The user can have hand soap in the reservoir and use the dispenser at Christmas time. After Christmas, the user can have a different dispenser.

For instance, for January, the decorative element 40 or 40' can have a Winter scene such as a snowman-like appearance to depict the Winter season, with the particles in suspension colored white. In February, the decorative element 40 or 40' can be a Valentine's Day theme of Cupid and hearts (with the particles in suspension colored red), or a President's Day theme showing a bust of Lincoln or Washington, with red, white and blue particles in suspension.

For March, the decorative element 40 or 40' can be a St. Patrick's Day theme, e.g., shamrocks, with the particles in suspension colored green. For March or April, the decorative element 40 or 40' can be an Easter theme, e.g., an Easter Bunny, with the particles in suspension being colored in pastel colors (such as the color of Easter eggs), to depict Easter eggs around an Easter Bunny. For Spring and Summer months, scenery depicting these themes can be the decorative element 40 or 40' and the particles in suspension can reflect light, to sparkle for those seasons (e.g., to depict sunshine), or can be blue in color to depict rain drops ("April showers bring May flowers"). For Memorial Day, the decorative element can be an American Flag with red, white and blue particles in suspension.

For Independence Day (July 4), the decorative element 40 or 40' can depict exploding fireworks and the particles in suspension can be silver colored to reflect light. For Labor Day, the decoration element also can be an American Flag with red, white and blue particles in suspension, or showing people working with reflective, sparkling particles in suspension. And, for Autumn, the decorative element 40 or 40'can depict trees and the particles in suspension can be brown to symbolize falling leaves, or a Halloween or a Thanksgiving turkey scene, e.g., a skeleton or jack-o-lantern or witch or vampire or ghost or the like, with suitably-colored particles.

Alternatively, decorative element 40 or 40' can depict a scene from a location, like a city skyline, in the same way traditional "snow globes" depict scenes.

It is to be further understood that any utilitarian description herein of any component of the dispenser of the invention, is not to be construed as a statement that the appearance of any component of the invention is necessarily only functional in nature. Surface ornamentation or configuration of the dispenser or any components thereof are attributable to ornamental considerations.

Having thus described in detail preferred embodiments of the present invention, it is to be understood that the invention defined by the appended claims is not to be limited to particular details set forth in the above description as many apparent variations thereof are possible without departing from the spirit or scope of the present invention.

What is claimed is:

1. A dispenser comprising a hollow decorative vessel comprising a decorative element, said decorative vessel being sealed and capable of containing a first liquid, a reservoir permanently connected to the hollow decorative vessel, said reservoir being capable of containing a second liquid and having an interior therefore, and a pumping means for dispensing the second liquid from the interior of the reservoir; whereby a user of the dispenser is able to dispense the second liquid from the reservoir, without admixture of the first and second liquids.

2. The dispenser of claim 1 wherein the hollow decorative element is surrounded by the reservoir.

3. The dispenser of claim 1 wherein the hollow decorative element contains the reservoir.

4. The dispenser of claim 1 wherein the hollow decorative element is positioned above the reservoir.

5. The dispenser of claim 1 wherein the hollow decorative element is positioned below the reservoir.

6. The dispenser of claim 1 wherein the dispensing means is a screw cap assembly for pour dispensing.

7. The dispenser of claim 1 wherein the dispensing means is a pump dispenser for pump dispensing.

8. The dispenser of claim 1 wherein the dispensing means is an aerosol dispensing means for spray dispensing whereby the reservoir is an aerosol container.

9. The dispenser of claim 1 containing the first liquid and having particles in the first liquid which are capable of being in temporarily in suspension after the first liquid is shaken or agitated.

10. A method for dispensing a liquid from a dispenser comprising providing a dispenser comprising a hollow decorative vessel comprising a decorative element, said decorative vessel being sealed and capable of containing a first liquid, a reservoir permanently connected to the hollow decorative vessel, said reservoir being capable of containing a second liquid and having an interior therefore, and a pumping means for dispensing the second liquid from the interior of the reservoir; whereby a user of the dispenser is able to dispense the second liquid from the reservoir through a dispensing means without admixture of the first and second liquids.

11. A dispenser comprising a first vessel and a sealed second vessel, wherein the first and second vessels are permanently connected, the first vessel comprises a pumping means for dispensing a first liquid from its interior, and the second vessel comprises a hollow decorative vessel comprising means for permitting a user to view a sculpture and a second liquid within its interior, whereby a user of the dispenser is able to dispense the first liquid from the first vessel through a functional dispensing means without admixture of the first and second liquids.

12. The dispenser of claim 11 wherein the dispensing means of the first vessel comprises an open mouth bottle or tube and a removable cover, or a pump dispenser mechanism or an aerosol.

13. The dispenser of claim 11 wherein the second vessel contains a second liquid, and optionally particles capable of being temporarily in suspension when the second liquid is shaken or agitated.

14. The dispenser of claim 11 further comprising means to dispense the first liquid passing through the second vessel.

15. The dispenser of claim 11 wherein the first vessel is positioned above the second vessel, and optionally there is no means for dispensing the first liquid which passes through the second vessel.

16. The dispenser of claim 11 wherein the first and second dispensers are positioned adjacent each other.

17. The dispenser of claim 14 wherein the first vessel is positioned below the second vessel.

18. The dispenser of claim 11 wherein the means for permitting a user to view a sculpture within, its interior comprises the second vessel being transparent or translucent.

19. The dispenser of claim 11 wherein the means for permitting a user to view the sculpture within its interior comprises the second vessel being translucent and having frosting or a color imparted to the second vessel.

20. The dispenser of claim 11 wherein the means for permitting a user to view a sculpture within its interior comprises a the second vessel having discrete portions, wherein at least one first portion allows for viewing of the sculpture and at least one second portion does not permit for viewing of the sculpture.

21. The dispenser of claim 11 wherein the first vessel is refillable or replaceable.

22. The dispenser of claim 11 wherein the first vessel is positioned within the second vessel.

23. The dispenser of claim 11 wherein the second vessel is positioned within the first vessel.

24. A method for dispensing a liquid from a dispenser comprising providing a dispenser comprising a first vessel and a sealed second vessel, wherein the first and second vessels are permanently connected, the first vessel comprises a pumping means for dispensing a first liquid from its interior, and the second vessel comprises a hollow decorative vessel comprising means for permitting a user to view a sculpture and a second liquid within its interior; whereby a user of the dispenser is able to dispense the first liquid from the first vessel through a dispensing means without admixture of the first and second liquids.

* * * * *